US005839609A

United States Patent [19]

Zakensberg

[11] Patent Number: 5,839,609

[45] Date of Patent: Nov. 24, 1998

[54] THERMOFORMED PACK WITH RIDGE VALVE

[75] Inventor: Issac Zakensberg, Scotch Plains, N.J.

[73] Assignee: Colgate-Palmolive Company, New York, N.Y.

[21] Appl. No.: 921,926

[22] Filed: Aug. 27, 1997

[51] Int. Cl.[6] ..... B65D 37/00; B65D 35/28

[52] U.S. Cl. ..... 222/107; 206/484; 206/820; 222/212; 222/541.6; 222/547; 222/564

[58] Field of Search ..... 206/277, 484, 206/820; 222/107, 541.6, 547, 564, 212, 213, 494

[56] References Cited

U.S. PATENT DOCUMENTS

| | | | |
|---|---|---|---|
| 3,184,121 | 5/1965 | Volckening | 222/541.6 X |
| 3,278,085 | 10/1966 | Brown | 222/541.6 X |
| 3,635,376 | 1/1972 | Hellstrom | 222/107 |
| 3,862,684 | 1/1975 | Schmitt | 206/277 |
| 4,491,157 | 1/1985 | Hashimoto . | |
| 4,759,472 | 7/1988 | Strenger | 222/564 X |
| 4,872,556 | 10/1989 | Farmer | 206/484 |
| 4,890,744 | 1/1990 | Lane, Jr. et al. | 206/484 X |
| 4,917,267 | 4/1990 | Laverdure | 222/107 |
| 4,921,137 | 5/1990 | Heijenga | 222/107 |
| 4,928,852 | 5/1990 | Guiffray . | |
| 5,131,760 | 7/1992 | Farmer | 222/107 X |
| 5,411,178 | 5/1995 | Roders et al. | 222/107 X |
| 5,529,224 | 6/1996 | Chan et al. | 222/107 X |

*Primary Examiner*—Bryon P. Gehman
*Attorney, Agent, or Firm*—Michael McGreal

[57] ABSTRACT

The thermoformed package has a positive sealing ridge valve so that portions of the thermoformed package can be dispensed at different times. There is a relatively thick, shaped bottom sheet and a relatively thin, substantially planar, top sheet. The top sheet is bonded to the shaped bottom sheet around the perimeter of the shaped bottom sheet. At one end of the shaped bottom sheet there is a narrowed region with at least two recesses and a ridge separating the recessed areas. The ridge extends to or above the top surface of the shaped bottom sheet. The top sheet and the ridge cooperate to form a ridge valve to seal the body portion of the thermoformed package from a dispensing opening until a positive force is applied to the body portion. The thermoformed package is opened by the removal of a tab located beyond the recesses and ridge. The recesses and ridge in the shaped bottom sheet and the relatively thin top sheet form an effective sealing valve.

16 Claims, 2 Drawing Sheets

THERMOFORMED PACK WITH RIDGE VALVE

FIELD OF THE INVENTION

This invention relates to a thermoformed dispensing pack that has a positive seal ridge valve. More particularly this invention relates to a thermoformed pack having a valve comprised of a plurality of recesses which substantially receive a top sheet of the pack to form a tortuous path ridge seal to positively seal the pack after opening.

BACKGROUND OF THE INVENTION

The present invention is directed to the problem of sealing a thermoformed pack once it has been opened and a portion of the contents removed. These thermoformed packs usually are opened by removing a part of the pack to expose an opening. Upon putting pressure on the main body of the pack, some of the contents can be dispensed. The remainder stays in the pack. The present invention provides a positive sealing ridge valve arrangement so that after each dispensing the contents are sealed within the body of the pack. The ridge valve is comprised of a plurality of recesses separated by one or more ridges so that the top sheet substantially enters the recesses and forms a seal with each ridge and recess. This sealing is enhanced when the pack materials are wetted by the contained liquid with the surface tension of the liquid assisting in holding the top sheet in close proximity to the lower sheet of the valve.

Various types of valves for thermoformed packs are known. Packs with flat channel valves are disclosed in U.S. Pat. No. 3,184,121; U.S. Pat. No. 4,491,157 and U.S. Pat. No. 5,529,224. In FIG. 6 of U.S. Pat. No. 3,184,121 there is shown two parallel flat sheets of material that are opened to dispense a product by a force on the walls of the pack. A related valve mechanism is shown in U.S. Pat. No. 4,917,867. FIG. 5C shows the valve in a dispensing condition. U.S. Pat. No. 5,529,224 is directed to various embodiments of flat channel valves in combination with a thermoformed container. Flat channel valves are well known in the art. However, they have a disadvantage in that they do not provide a positive sealing. Further, the thickness and other characteristics of the thermoformed container materials must be closely designed to provide a reasonably good seal.

Another type of seal is a deformable seal. This is described in U.S. Pat. No. 3,635,376, U.S. Pat. No. 4,928,852 and to an extent in U.S. Pat. No. 5,529,224, FIGS. 26 through 30. In this type of valve one sheet, usually the upper sheet, is designed to have a sufficient integrity to be moved manually from an open position to a closed position. The top sheet is moved manually from an upper position where the valve is open to a lower position where the valve is closed. The manual opening and closing of this type of valve is more clearly shown in FIG. 7 of U.S. Pat. No. 4,928,852.

Despite the efforts of the inventors of the valve mechanisms of these patents, there has not been achieved a simple, automatic, positive sealing valve for a thermoformed pack. The valves that require manual manipulation require a person to remember to seal the pack, while flat channel valves are not positive sealing.

The problem is solved using the present ridge valve. This is comprised of a slightly flexible, resilient lower sheet and a highly flexible upper sheet. The lower sheet will have a thickness greater than the top sheet. This will be a thickness of about 50% to about 500% more than the top sheet. The bottom sheet in the valve portion will have a plurality of recesses, each recess separated by a ridge. The top sheet substantially conforms to the shape of each recess with a complete contact with each ridge. This produces a tortuous path for the dispensing of any liquid. The liquid must lift the top sheet from each ridge and out of each recess. This produces an automatic valve that provides for positive sealing of a thermoformed pack.

BRIEF SUMMARY OF THE INVENTION

The invention comprises a thermoformed pack that is comprised of a body portion and a valve portion. The body portion is a hollow body that is of a set volume, sealed at one end, and open through a valve at another end upon the removal of a seal. The valve portion is a ridge valve which is comprised of a plurality of recesses which are each separated by a ridge extending upwardly from a shaped lower film that forms the pack. The lower film is resilient and moderately flexible. A highly flexible upper sheet covers the pack, this highly flexible upper sheet substantially entering each of the recesses and completely contacting each ridge.

The lower film has a thickness that is 100% to about 3000% that of the upper film. The upper film will have a thickness of about 0.025 mm to about 0.25 mm and the lower film will have a thickness of about 0.25 mm to about 0.75 mm. The one or more ridges will project upwardly at least to the plane of the top surface of the shaped bottom film and in a further embodiment to above the plane of the shaped bottom film.

The pack is made by thermoforming the shaped bottom film from a first film and bonding a second film to the shaped first film. The second film is substantially planar and is bonded to the periphery of the shaped first film. However, even so bonded, the second film is sufficiently flexible to extend substantially into each recess of the valve portion and to be in a complete and positive contact with each of the ridges between each of the recesses.

DETAILED DESCRIPTION OF THE DRAWINGS

The thermoformed pack will now be described in more detail with reference to the attached drawings. The thermoformed pack is made by the process of thermoforming a first film to a shape to hold a liquid. In thermoforming a film is heated and drawn into a mold so that the film gains the shape of the mold. The formed first film then is filled with a liquid and an essentially flat highly flexible film bonded to the periphery of the first film. The liquid then is sealed into the pack.

Figure 1:
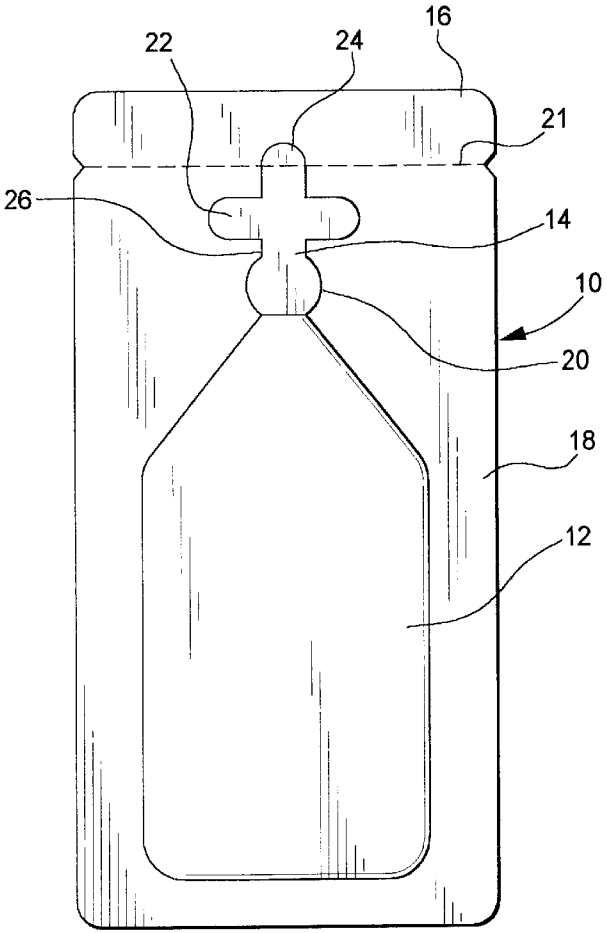
FIG. 1 is a top plan view of the thermoformed pack in an unopened condition.

In FIG. 1 the thermoformed pack 10 is comprised of a body portion 12 and valve portion 14. The peripheral area 18 is a primarily planar region where the first film 28 and second film 30 are bonded. A portion 16 is a breakaway tab for opening the pack. By tearing along serrated line 21 the tab 16 can be removed.

Figure 2:
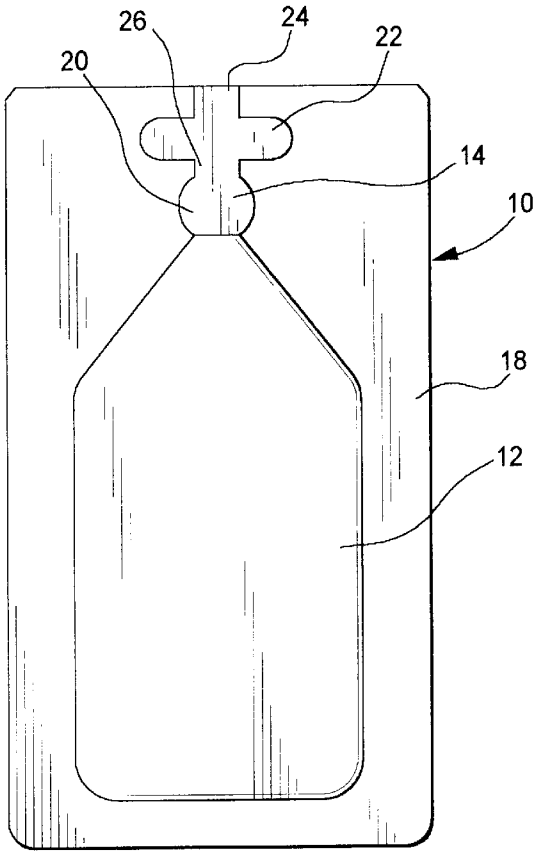
FIG. 2 is a top plan view of the thermoformed pack opened.

The body portion 12 comprises a chamber of essentially any shape that can be produced by thermoforming. It will contain from as little as 10 ml of a liquid up to about 100 ml or more. The valve portion is comprised of recesses 20 and 22 and a separating ridge 26. The dispensing opening is noted as 24. FIG. 2 is a view that is the same as FIG. 1 but with tab 16 removed. The pack in FIG. 2 is in a condition for dispensing.

Figure 3:
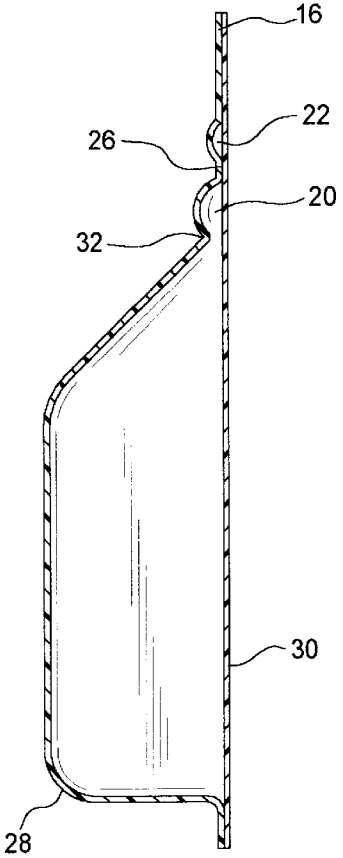
FIG. 3 is a side elevational view of the packet of FIG. 1.
Figure 4:
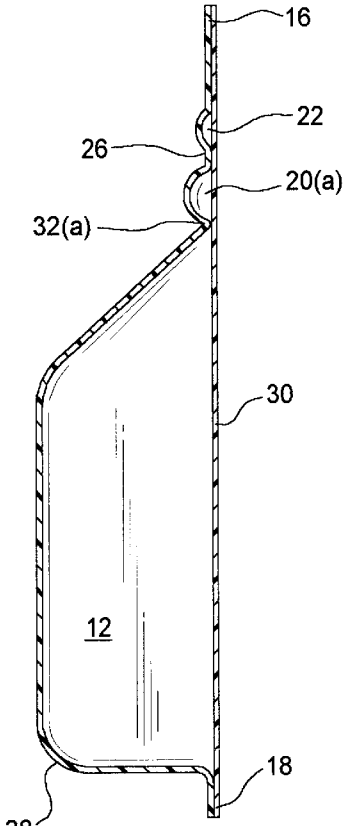
FIG. 4 is a side elevational view of another embodiment of the thermoformed pack.

FIG. 3 is a cross-sectional view of the thermoformed pack. The body portion that contains the liquid is seen in more detail. First film 28 forms the body portion and highly flexible film 30 forms the sealed top wall of the pack. The recesses 20 and 22 and the ridges 26 and 32 are shown in more detail. Ridge 32 is shown as below the plane of the top of ridge 26 and contacts the second film 30 due to a sagging of the highly flexible second film into the body portion. In the embodiment of FIG. 4 this ridge is shown as ridge 32(*a*) the top surface of which is in the same plane as the top surface of ridge 26.

Figure 5:
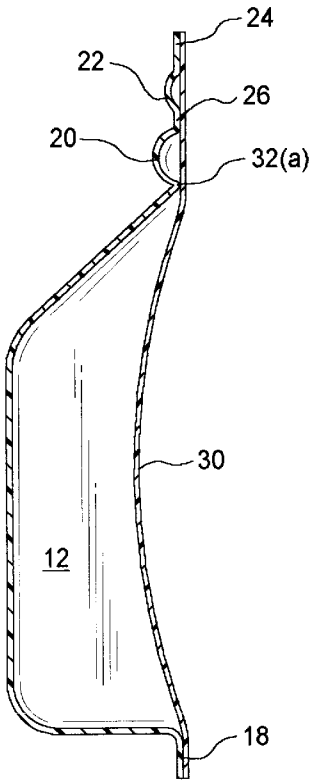
FIG. 5 is a side elevational view of the thermoformed pack in an opened condition.

FIG. 5 shows the thermoformed pack when opened and the second film 30 sagging into the body portion 12, as well as into recesses 20 and 22. This illustrates the highly flexible nature of this top film. This puts the second film into a complete contact with ridge 32(*a*) and ridge 26. The second film also extends substantially into recesses 20 and 22. This produces a tortuous path for the discharge of the contained liquid. It also provides for an effective valve with positive sealing of the pack after opening.

Figure 6:
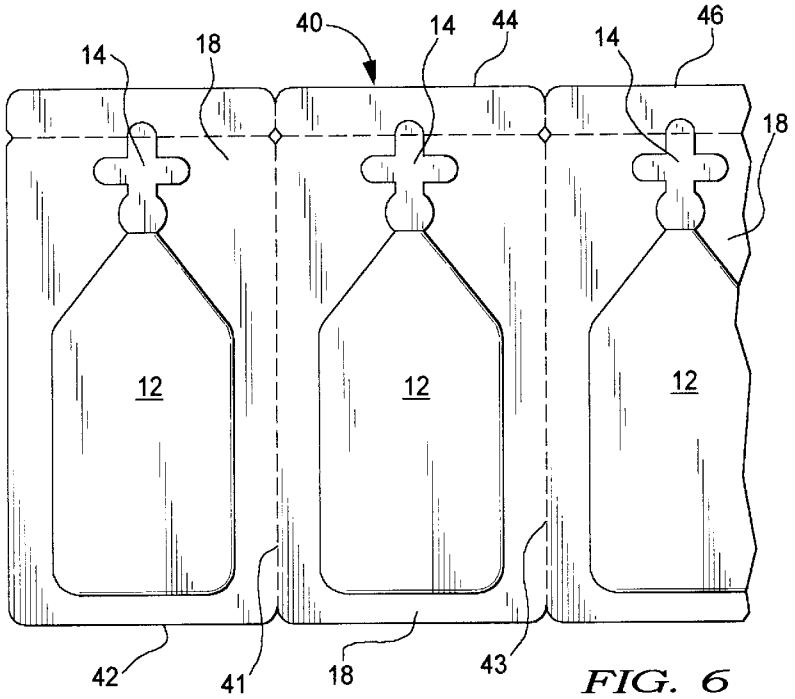
FIG. 6 is a top plan view of the thermoformed pack as produced as a plurality of connected units.

In FIG. 6 there is shown a plurality 40 of the packs connected together. They are produced in this mode. Pack 42 is connected to pack 44 at serrated edge 41 while pack 44 is connected to pack 46 at serrated edge 43. By tearing along the serrated edge one pack can be separated from another. The other parts of the thermoformed packs have been described in the other figures.

In use, the upper tab portion 16 is removed by breaking off at the scored or weakened line 21. Then, by pressing the body portion 12 of the pack, some of the contents can be dispensed. When the pressure on the body portion is released, the top sheet 30 contacts ridge 26 to seal off additional flow from the container. Upon subsequent applications of pressure to the body 12 of the thermoformed pack, additional amounts of the contents of the pack are dispensed. This is continued until all of the contents are dispensed. The empty pack then is discarded.

The thermoformed pack can be made from any of the thermoformable materials having the appropriate melt strength. These include the polyolefins, with polyethylene and polypropylene being preferred. Other resins that can be used are polyethylene terephalate, polyethylene terephalate glycol modified, high density polyethylene, and laminates, multilayered composites comprised of olefins and other thermoformable materials.

The first film that forms the lower part of the pack is resilient and moderately flexible. The material will have a thickness of about 0.25 mm to about 0.75 mm. The second film will have a thickness of about 0.025 mm to about 0.25 mm. The objective is for the first film to be slightly to moderately flexible and for the second film to be highly flexible.

What is claimed is:

1. A thermoformed pack having a body portion and a valve portion, said body portion terminating at one end in said valve portion, said body portion and said valve portion being closed by a substantially planar top wall having a thickness less than that of said body portion and said valve portion, said valve portion having a dispensing opening sealed by a breakaway tab, a first recess chamber and a second recess chamber separated by a separating ridge, said top wall contacting said separating ridge and being sufficiently flexible to extend into each of said first chamber and said second chamber, said first recess chamber, said second recess chamber and said substantially planar top wall closing said valve portion upon the removal of said breakaway tab and the absense of a dispensing force on said body portion.

2. A thermoformed pack as in claim 1 wherein said first chamber is adjacent said body portion, said second chamber terminating in a means to open said thermoformed pack.

3. A thermoformed pack as in claim 1 wherein said second recess chamber has a transverse lateral dimension greater than said first recess chamber.

4. A thermoformed pack as in claim 3 wherein said second recess chamber has a longitudinal dimension greater than said first recess chamber.

5. A thermoformed pack as in claim 1 wherein said top wall is attached to said body portion around a periphery of said body portion.

6. A thermoformed pack as in claim 5 wherein said top wall is attached around a periphery of said valve portion.

7. A thermoformed pack as in claim 1 wherein said body portion and said valve portion have a thickness of about 0.25 mm to about 0.75 mm and said top wall has a thickness of about 0.025 mm to about 0.25 mm.

8. A thermoformed pack as in claim 1 wherein there is an end wall ridge between said body portion and said valve portion, said top wall being flexible the flex into said body portion and to contact said end wall ridge.

9. A thermoformed pack as in claim 8 wherein said top wall contacts said valve portion at said end wall ridge and at said separating ridge.

10. A thermoformed pack as in claim 1 containing a liquid product, said liquid product at least wetting said top wall to line said top wall downwardly into said body portion and said valve portion.

11. A thermoformed pack as in claim 1 wherein an upper surface of said separating ridge is in a plane of the top surface of said body portion and said valve portion.

12. A thermoformed pack as in claim 1 wherein an upper surface of said separating ridge is below the plane of the top surface of said body portion and said valve portion.

13. A thermoformed pack as in claim 1 wherein an upper surface of said separating ridge is above the plane of the top surface of said body portion and said valve portion.

14. A thermoformed pack as in claim 1 wherein said valve portion has a means to dispense at one end and at an other end a means to flow a liquid into said valve portion.

15. A thermoformed pack as in claim 1 wherein between said dispensing opening and said separating ridge there is an elongated lateral section into which said top wall enters on a side of said separating ridge.

16. A thermoformed pack as in claim 15 wherein in said valve portion between said separating ridge and said end wall ridge there is a liquid holding recess chamber.

* * * * *